US008100621B2

(12) United States Patent
Budny et al.

(10) Patent No.: US 8,100,621 B2
(45) Date of Patent: Jan. 24, 2012

(54) DISCHARGE HOPPER AND METHOD OF DISCHARGING SHAFT TRAYS FILLED WITH ROD-SHAPED PRODUCTS

(75) Inventors: Piotr Budny, Hamburg (DE); Thomas Mueller, Hamburg (DE); Matthias Horn, Ahrensburg (DE); Michael Knabe, Geesthacht (DE); Arnd Meier, Beckdorf (DE)

(73) Assignee: Hauni Maschinenbau AG, Hamburg (DE)

( * ) Notice: Subject to any disclaimer, the term of this patent is extended or adjusted under 35 U.S.C. 154(b) by 922 days.

(21) Appl. No.: 12/068,080

(22) Filed: Feb. 1, 2008

(65) Prior Publication Data

US 2008/0213072 A1 Sep. 4, 2008

(30) Foreign Application Priority Data

Feb. 3, 2007 (DE) ..... 10 2007 006 133

(51) Int. Cl.
*B65B 21/02* (2006.01)

(52) U.S. Cl. .... 414/403; 414/407; 414/414; 414/416.06

(58) Field of Classification Search ..... 414/403, 414/407, 414, 416.06, 416.08, 745.1, 14; 82/126

See application file for complete search history.

(56) References Cited

U.S. PATENT DOCUMENTS

| | | | | |
|---|---|---|---|---|
| 4,365,703 | A | 12/1982 | Hinchcliffe et al. | |
| 4,514,958 | A * | 5/1985 | Hoorn | 53/284.4 |
| 5,515,137 | A * | 5/1996 | Arnold et al. | 355/40 |
| 6,065,358 | A | 5/2000 | Shepherd | |

FOREIGN PATENT DOCUMENTS

| | | |
|---|---|---|
| DE | 1 915 446 | 5/1965 |
| DE | 2 347 674 | 4/1974 |
| EP | 1 308 101 A1 | 10/2002 |
| GB | 2 017 618 A | 10/1979 |

OTHER PUBLICATIONS

European Office Action dated Aug. 3, 2009, issued in related European Patent Application No. 08075087.0, and its corresponding English-language translation.

Chinese Patent Office Action dated Sep. 26, 2011 issued in Chinese Appl. No. 200810009586.2 (w/ English Translation).

* cited by examiner

*Primary Examiner* — Saul Rodriguez

*Assistant Examiner* — Willie Berry, Jr.

(74) *Attorney, Agent, or Firm* — Venable LLP; Robert Kinberg; Ryan M. Flandro

(57) ABSTRACT

A discharge hopper for a tray discharge station for serially discharging shaft trays filled with rod-shaped products includes a conveying element for carrying away the products flowing from the shaft trays and a connecting device for coupling the shaft trays to be emptied to the conveying element. The connecting device is arranged substantially parallel to and spaced apart from the conveying element to form a channel for the product flow and includes an opening for passage of the products from the shaft tray into the channel. In the region of the connecting device there is provided a closure unit to open and close the opening. The closure device is coupled to a movable actuating element so that the closure device can be opened and closed shaft by shaft in relation to the shaft tray to be emptied.

22 Claims, 8 Drawing Sheets

DISCHARGE HOPPER AND METHOD OF DISCHARGING SHAFT TRAYS FILLED WITH ROD-SHAPED PRODUCTS

CROSS-REFERENCE TO RELATED APPLICATIONS

This application claims the priority of German Patent Application No. 10 2007 006 133.3, filed on Feb. 3, 2007, the subject matter of which is incorporated herein by reference.

BACKGROUND OF THE INVENTION

The invention concerns a discharge hopper for a tray discharge station for serially discharging shaft trays filled with rod-shaped products, comprising a conveying element for carrying away the products flowing from the shaft trays as well as a connecting means for coupling the shaft trays to be emptied to the conveying element, the connecting means being arranged substantially parallel to and spaced apart from the conveying element to form a channel for the product stream and comprising an opening for passage of the products from the shaft tray into the channel.

Furthermore the invention concerns a method for serially discharging shaft trays filled with rod-shaped products with the steps of: delivering a shaft tray to be emptied into the region of a channel formed by a conveying element and a connecting means, opening the upside-down shaft tray, and carrying away the products which drop out of the shaft tray into the channel, by the conveying element.

Such apparatuses and methods are used in particular in the tobacco-processing industry, in the processing of rod-shaped products. For different reasons, cigarettes, filter rods or the like are kept for storage in containers, the so-called trays. Preferably, the containers are designed as shaft trays in which the products lie in several shafts separate from each other. For further processing of the stored products, they are discharged to subsequent devices, e.g. packing machines or the like, or funnelled into an existing mass flow. For automated delivery of the articles from the containers, usually discharge stations are available. The discharge stations comprise in a known manner a delivery means for product-filled trays, a discharge hopper, a removal device for the empty trays and a transfer device by means of which the full trays are transported from the delivery means into the region of the discharge hopper and the empty trays are transported from the discharge hopper into the region of the removal device. The discharge hopper essentially includes a conveying element for carrying away the products flowing from the shaft trays and a connecting means for coupling the shaft trays to be emptied to the conveying element. The transfer device can vary in construction. Widespread are pivot devices which have a receptacle for one or more trays and which are assigned a movable closure element for the open-topped trays. This closure element as part of the transfer device is usually a so-called slide bottom which in the closed state prevents the products from dropping out of the shafts of the shaft tray into the region of the connecting means during rotation or during upside-down pivoting.

From document GB 2 017 618 A is known e.g. an apparatus having the features of the preamble of claim 1. The apparatus for emptying shaft trays disclosed in the GB document includes a discharge hopper which comprises a conveying element and a connecting means. The shaft trays to be emptied are coupled to the conveying element in the region of the connecting means. For discharge, the closure means associated with the shaft tray is opened so that the products drop directly out of the shaft tray into the channel formed by the connecting means and the conveying element. In this case each shaft of the shaft tray is assigned a flap, the flaps of the shafts of a shaft tray opening one after the other. This apparatus or the corresponding method however has the drawback that a shaft must first be completely emptied and the flap which opens the shaft must be closed again before the next shaft can be emptied. This leads firstly to delays and hence an ineffective discharge operation. Secondly, the product stream breaks away on the continuously driven conveying element. In other words, no continuous product stream is formed within the channel, so that products lie on the conveying element in a disorderly fashion, which can lead to quality problems.

SUMMARY OF THE INVENTION

It is therefore the object of the invention to propose a discharge hopper which ensures high-quality and high-performance serial discharge of shaft trays. Furthermore it is the object of the invention to propose a corresponding method.

The object is achieved firstly by a discharge hopper of the kind mentioned hereinbefore by the fact that in the region of the connecting means is provided a closure means which is designed for opening and closing the opening, the closure means being functionally connected to a movable actuating element in such a way that the closure means of the discharge hopper can be opened and closed shaft by shaft in relation to a shaft tray to be emptied. As a result, on the one hand discharge which is particularly gentle to the product is made possible, as the products are more or less only deflected. On the other hand, due to the functional connection between the closure means and the actuating element, more or less positively controlled discharge of the shaft tray is ensured, resulting in a continuous product stream.

Preferably the actuating element is a slide which ensures easy and reliable operation, namely making the functional connection to the closure means.

In an appropriate development of the invention the closure means includes several shaft barriers, the number of shaft barriers corresponding at the maximum to the number of shafts of the shaft trays to be emptied. This facilitates discharge shaft by shaft in a particularly reliable manner.

A preferred embodiment of the invention is characterised in that each shaft barrier consists of two slidable closure plates, the two closure plates of a shaft barrier being arranged on opposite sides of the channel. Hence the opening operation or actual release of the products from the shaft tray is shortened. Furthermore uniform outflow of the products from the individual shafts of the shaft tray is assisted.

A further appropriate embodiment provides that the closure means is a belt element. Hence likewise opening of the shafts which is particularly gentle to the products and takes place one shaft at a time can be carried out.

Advantageously the slide on the side facing towards the product stream which is in the channel is provided with a radius for forming a deflection means. As a result, the products dropping out of the shafts of the shaft tray are guided particularly gently into the channel.

A preferred development of the invention is distinguished in that the slide forms an integral part of the conveying element. Hence the conveying element is of more or less multifunctional construction, because by means of the conveying element the product stream is carried away in the channel and furthermore the region of the conveying element formed into a slide serves to open and close the closure means. Another advantage lies in that the slide conveys the products flowing from the shafts actively into the region of the channel, as the slide itself forms part of the driven conveying element.

A particularly preferred variant of the invention is characterised in that the slide is assigned a feed element which is designed and shaped in such a way that the closure plates are forced apart both during movement of the slide in the direction of transport T and during movement in the direction opposite the direction of transport T. Hence, to put it conversely, the closure plates with the exception of engagement of the feed element between the closure plates are in a closed position. This produces a buffer for a change of shaft tray, so that during discharge of the channel a shaft tray which has just been emptied can be exchanged for a full shaft tray.

The object is also achieved by a method with the steps mentioned hereinbefore by the fact that all shafts of the shaft tray are opened simultaneously and the products flowing from the shafts of the shaft tray are at least partially retained on a closure means immediately above the channel before the closure means discharges the products shaft by shaft to the channel by means of a movable actuating element. The resulting advantages have already been described in connection with the discharge hopper according to the invention, on account of which reference is made to the corresponding passages to avoid repetition.

BRIEF DESCRIPTION OF THE DRAWINGS

Further preferred features or appropriate developments and steps of the method are apparent from the subsidiary claims and the description. Particularly preferred embodiments are described in more detail with the aid of the attached drawings. The drawings show:

DETAILED DESCRIPTION

The described discharge hoppers serve to discharge shaft trays filled with rod-shaped products.

Figure 1:
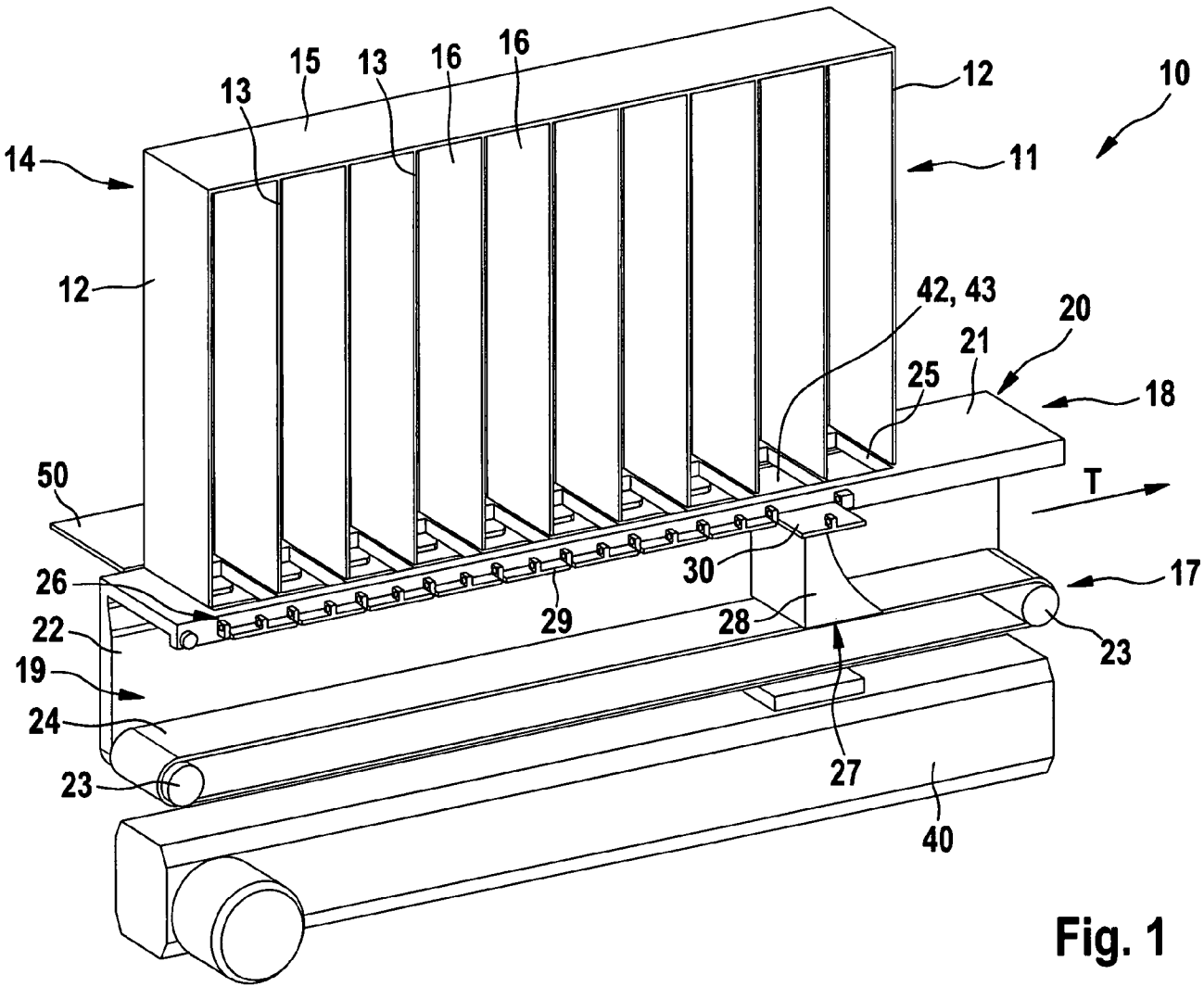
FIG. 1 a perspective view of a first embodiment of a discharge hopper obliquely from above, FIG. 2 a front view of the discharge hopper according to FIG. 1, FIG. 3 a perspective view of the discharge hopper according to FIG. 1 obliquely from below, FIG. 4 a perspective view of another embodiment of a discharge hopper obliquely from below, FIG. 5 a front view of the discharge hopper according to FIG. 4, FIG. 6 a perspective view of another embodiment of a discharge hopper obliquely from above, FIG. 7 a front view of the discharge hopper according to FIG. 6, and FIG. 8 a perspective view of the discharge hopper according to FIG. 6 obliquely from below.

In FIG. 1 is shown a first embodiment of such a discharge hopper 10 which is designed to discharge shaft trays 11. The shaft tray 11 has side walls 12, shaft walls 13 running parallel to the side walls 12, a rear wall 14 and a bottom wall 15. The shaft walls 13 are spaced apart from each other to form shafts 16. The discharge hopper 10 essentially includes a conveying element 17 and a connecting means 18. The conveying element 17 and the connecting means 18 are spaced apart from each other, this being in such a way as to form a channel 19 for the product stream. The conveying element 17 serves to carry away the products flowing from the shaft trays 11 out of the channel 19. The connecting means 18 is designed to couple the shaft trays 11 to be emptied to the conveying element 17. The connecting means 18 can be a support 20 which has a cover plate 21 and a rear wall 22 which defines the channel 19 at the rear, rear wall 22 and cover plate 21 being constructed in one piece and at an angle of about 90° to each other. On the side opposite the rear wall 22 can be arranged a front wall, not shown, so that the channel 19 is surrounded on all sides with the exception of the end faces. The conveying element 17 or deflecting and/or driving rollers 23 of the conveying element 17 are arranged or mounted in the region of the rear wall 22. By drive means, not shown, a belt element 24 can be driven in both directions. The cover plate 21 has an opening 25 which serves for passage of the products into the channel 19. Naturally this is only one of many embodiments of the connecting means 18. For instance, the connecting means 18 can also be a frame structure or the like. Also, the connecting means 18 can be e.g. constructed in several parts.

In the region of the connecting means 18 is provided a closure means 26. The closure means 26 is constructed and designed to open and close the opening 25. In particular, the closure means 26 is to be opened and closed shaft by shaft in relation to shafts 16 of a shaft tray 11 to be emptied. For this purpose the closure means 26 is functionally connected to an actuating element 27. The actuating element 27 is of movable construction, and is slidable within the channel 19 in the direction of transport T of the product stream and in the direction opposite the direction of transport T of the product stream. In other words, the actuating element 27 is preferably designed as a slide 28.

In the embodiments according to FIGS. 1 to 3 and 6 to 8, the closure means 26 is of segmented construction, as the closure means 26 includes several shaft barriers 29. The number of shaft barriers 29 corresponds at the maximum to the number of shafts 16 of the shaft trays 11 to be emptied. Preferably the number of shaft barrier 29 is n−1 in the event that the number of shafts is n. In the embodiment shown this means specifically that the shaft tray 11 has ten shafts 16 and the closure means 26 includes nine shaft barriers 29. Each shaft barrier 29 can be actuated and controlled individually, so that products of individual shafts 16 can be retained while products of another shaft 16 can drop into the channel 19. Each shaft barrier 29 consists of two closure plates 30, 31. The closure plates 30, 31 are slidable, this being towards each other for closing and away from each other for opening. For this purpose the closure plates 30, 31 are arranged on opposite sides of the channel 19 and movable transversely to the direction of transport T of the product stream. Even in the closed state of the closure plates 30, 31 the latter are spaced apart from each other, the distance between them being smaller than the length of the products, so that the products are prevented from passing through when the shaft barrier 29 is closed. But the distance between the closure plates 30, 31 can also be zero. The closure plates 30, 31 themselves are individually spring-loaded, the spring force basically causing the closure plates 30, 31 to be in their closed position. Naturally other embodiments of the shaft barriers 29 are possible, e.g. as single-piece slide or pivot plates or the like. Also the closure plates 30, 31 of one side can be connected to each other by a spring-loaded and/or weight-loaded cable (not shown) (principle of operation as in FIG. 4), the cable being passed through eyes or the like which are provided in the closure plates 30, 31 and in the cover plate 21. Also the closure plates 30, 31 can be capable of being actuated by means of pneumatic elements or the like.

Figure 4:
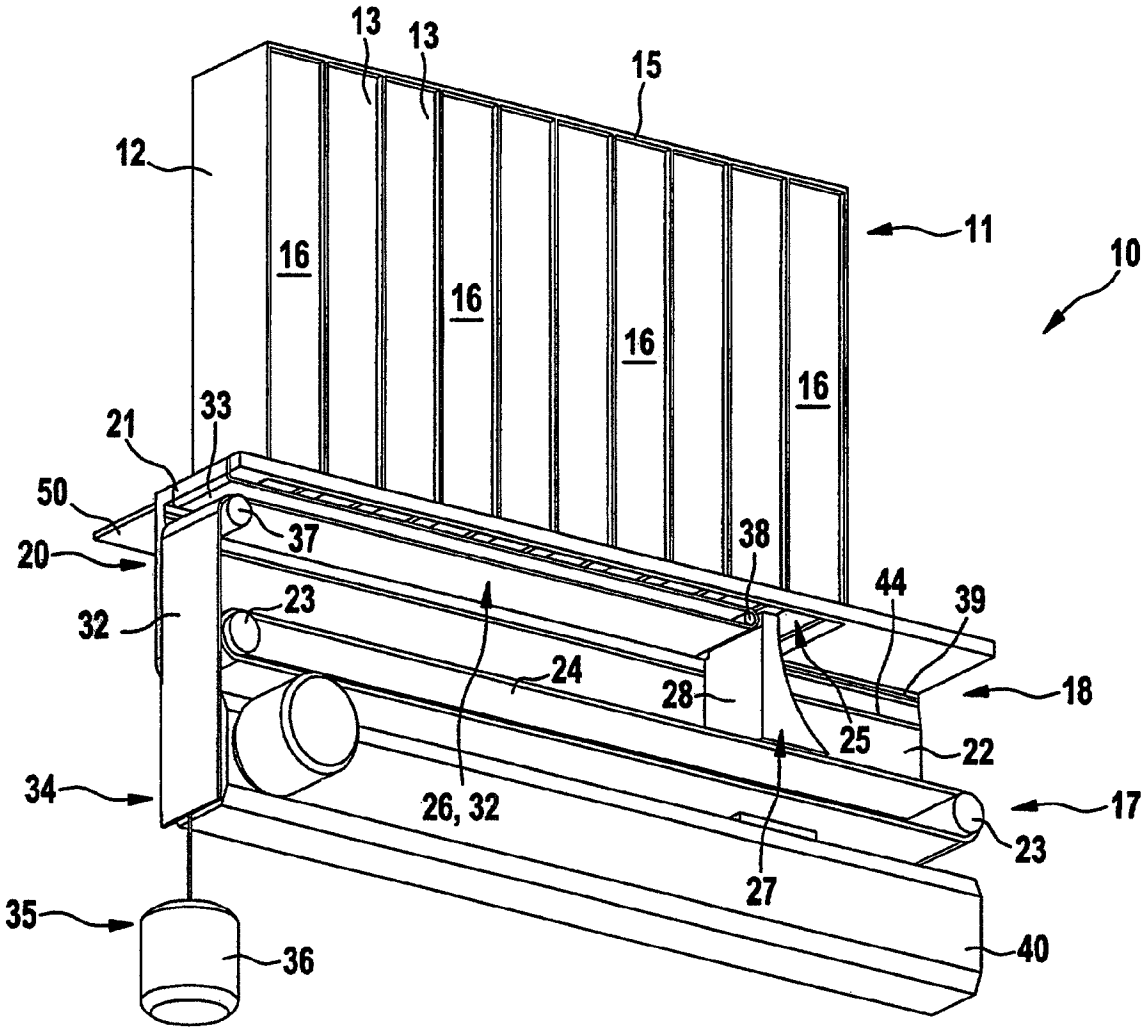
Figure 5:
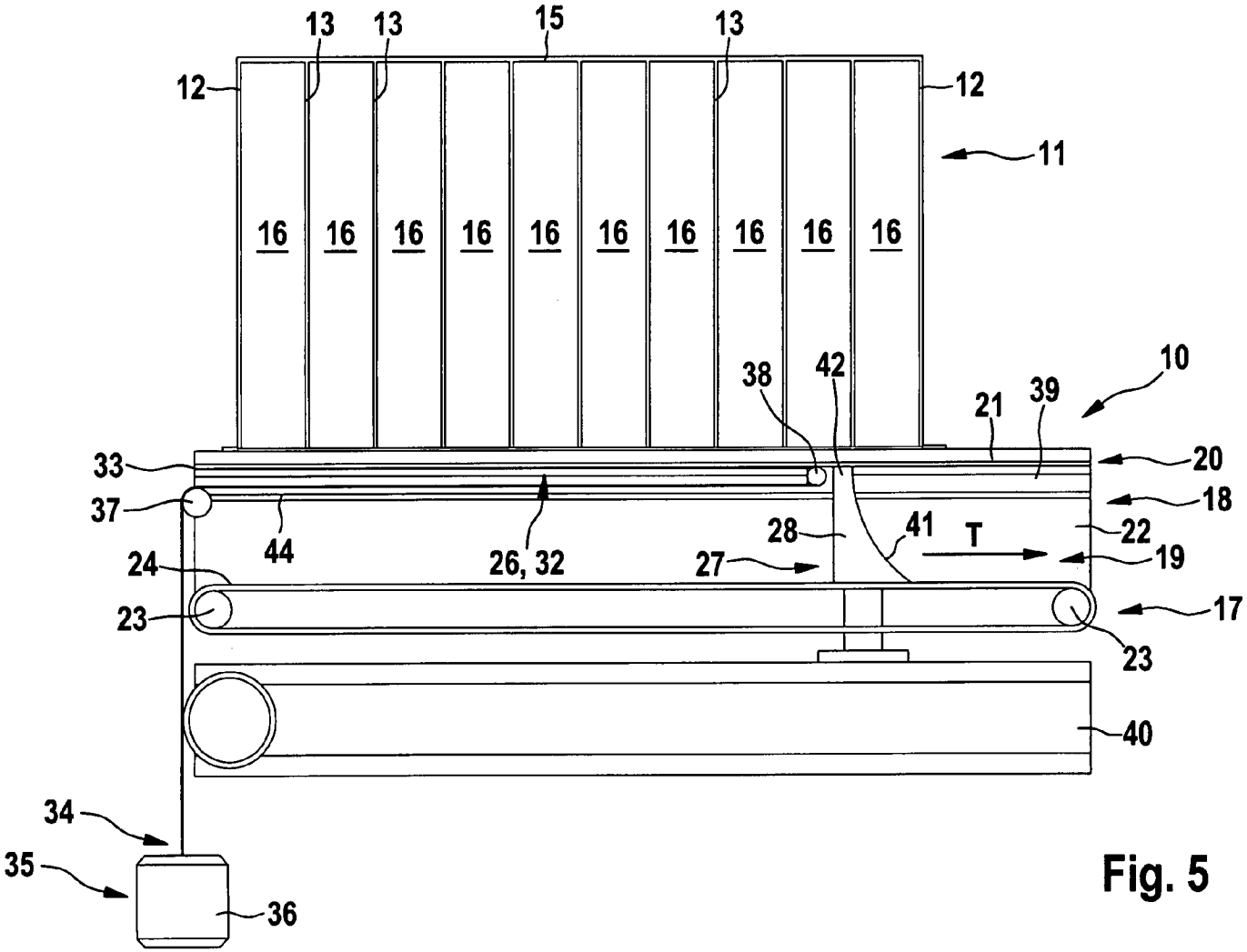

The embodiments according to FIGS. 4 and 5 has a closure means 26 which consists of a belt element 32. The belt element 32 is by one end 33 arranged on and attached to the connecting means 18 or, to be more precise, the cover plate 21. The other free end 34 is provided with a tensioning element 35. The tensioning element 35 can be e.g. a weight 36.

Other common tensioning systems are possible as well. The belt element 32 is further passed round several deflecting elements 37. In the embodiment described two deflecting elements 37, 38 are provided, of which at least one deflecting element 38 is movable. An essential reason for this is that there is no relative movement between the belt element 32 and the products in the shaft 16. For this the deflecting element 38 is mounted movably in a guide 39 in the region of the rear wall 22 and is movable parallel to the channel 19 to correspond to the slide 28 in the direction of transport T and in the direction opposite the direction of transport T, so that the shafts 16 can be opened and closed again step by step. The other deflecting element 37 is preferably arranged stationarily likewise in the region of the rear wall 22. The movement capacity and guiding of the or each movable deflecting element 38 as well as the arrangement and construction of the belt element 32 as a whole can of course also be realised with other known structural embodiments. Due to the capacity of the belt element 32 for displacement or, to be more precise, the capacity for adjusting the distance between the deflecting elements 37, 38, the closure means 26 is variable so that, when the distance between the deflecting elements 37, 38 is shortened, the shafts 16 are opened successively, while an increase in the distance leads to the shafts being closed again successively shaft by shaft.

A common feature of all the embodiments shown is that the slide 28 can be driven by means of a linear unit 40. But driving of the slide 28 can also be achieved otherwise by other drive units, cable systems or the like. The construction of the slide 28 can vary too. In the embodiments according to FIGS. 1 to 5, the slide 28 is a wedge-shaped element which is provided with a radius on the side which faces towards the product stream which is in the channel 19. To put it another way, the slide 28 on the side facing towards the products has a curved surface 41 which forms a deflector for the products dropping out of the shafts 16. At the top in the direction of the shafts 16 to be emptied, the slide 28 is of planar construction such that the upper surface 42 can also be designed to cover or close the opening 25 at least partially, preferably in the region of the shaft 16. The slide 28 can, on its side facing towards the closure means 26, that is, the surface 42, be designed so as to extend into the region of the closure means 26 and in particular into the region of the closure plates 30, 31, for opening the closure means 26. For this purpose the slide 28 in the region of the upper surface 42 may be assigned a feed element 43. The feed element 43 is preferably constructed in one piece with the slide 28 and designed and shaped in such a way that the closure means 26 and in particular the closure plates 30, 31 are forced apart both during movement of the slide 28 in the direction of transport T and during movement opposite the direction of transport T. The feed element 43 can be e.g. an arrow-shaped raised portion of material, with two arrow heads pointing in opposite directions and forming more or less a lozenge (see in particular FIG. 8). The feed element 43 has a rectangular through-opening between its arrow-shaped ends for passage of the products. But other embodiments and means for forcing the closure plates 30, 31 apart can be used too. The feed element 43 can also be a separate element which is guided in its own guide and, with a view to movement of the slide 28, is functionally connected to the latter for synchronous movement. The slide 28 is also guided in a guide 44 in the region of the rear wall 22.

Figure 6:
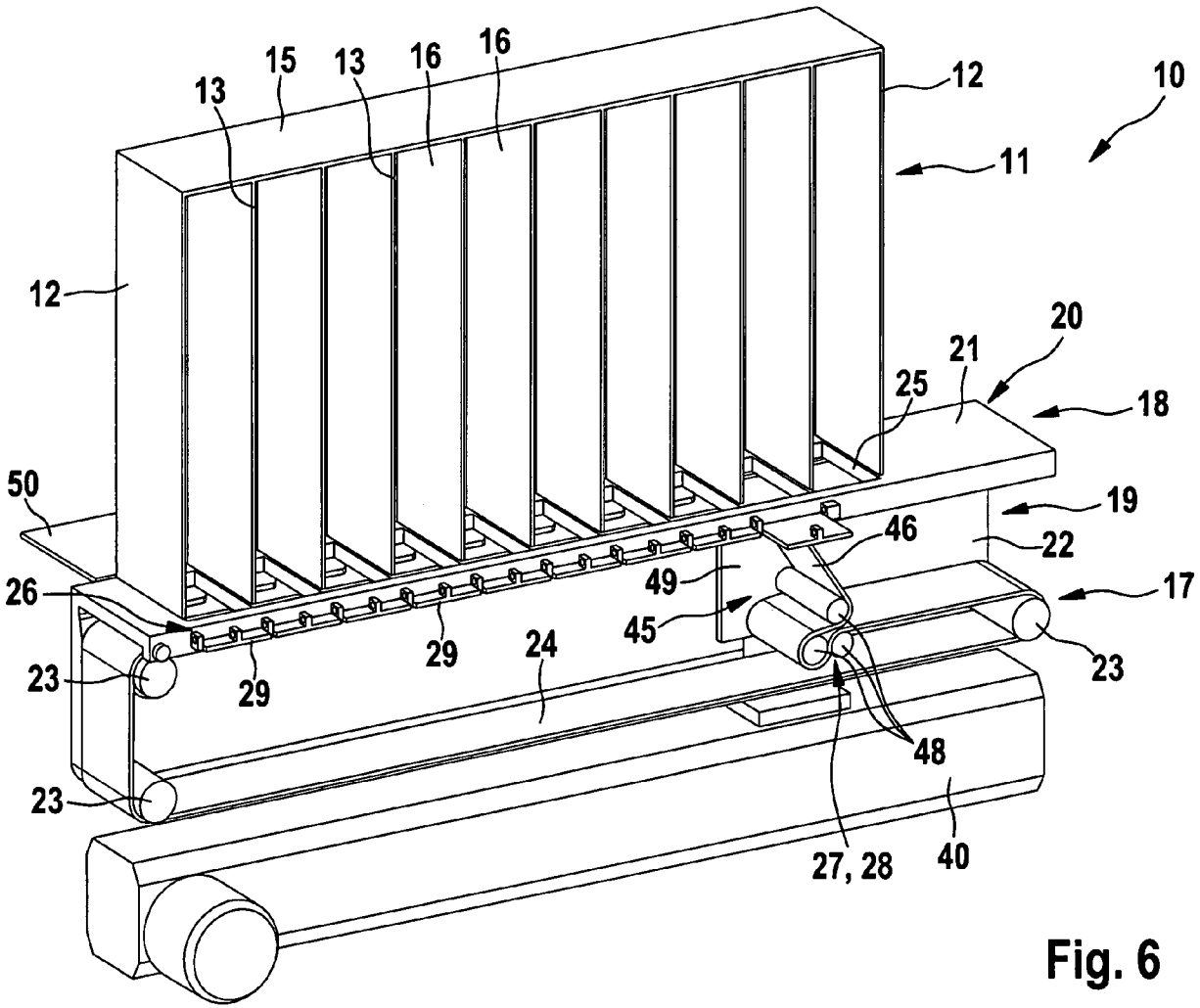
Figure 7:
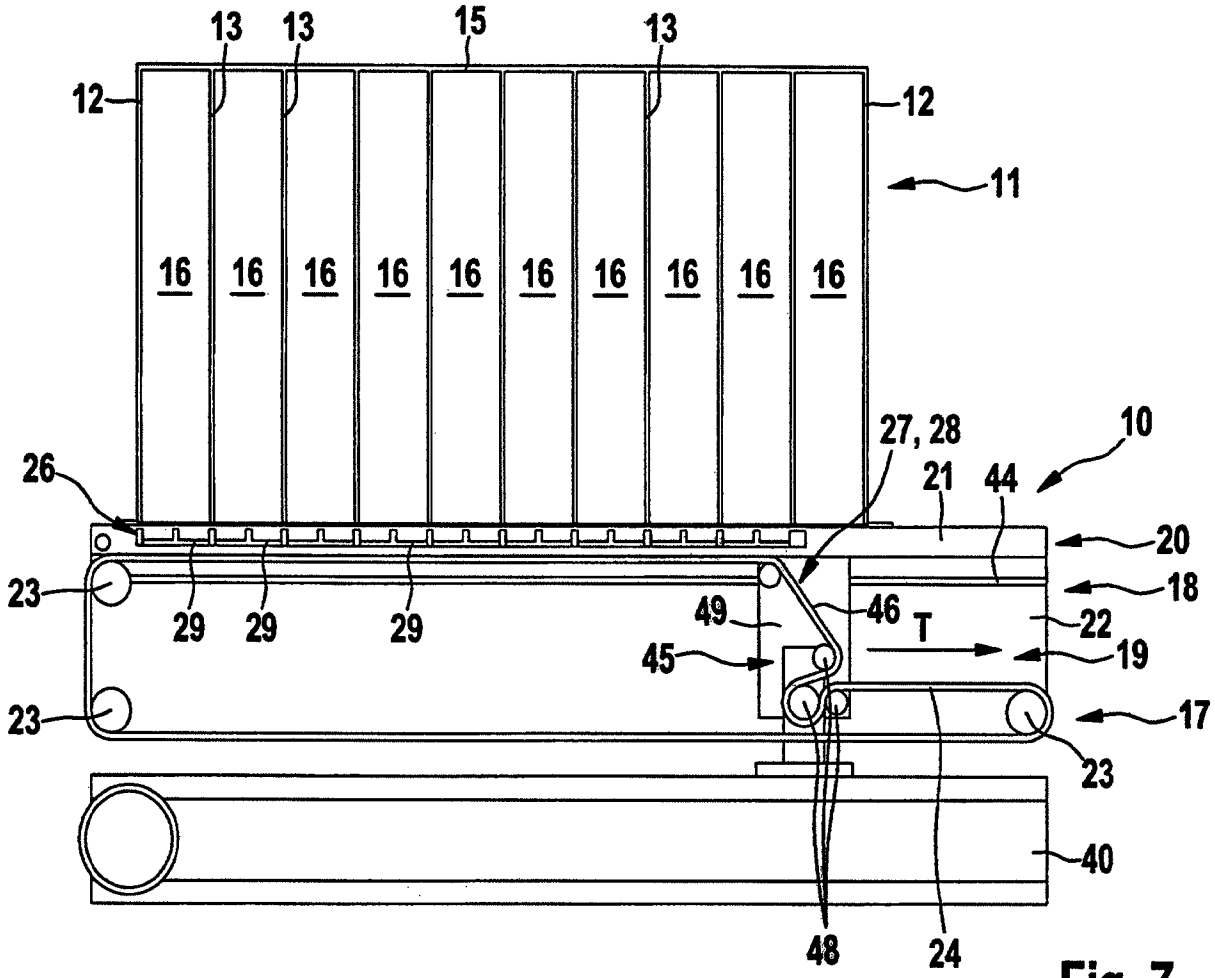
Figure 8:
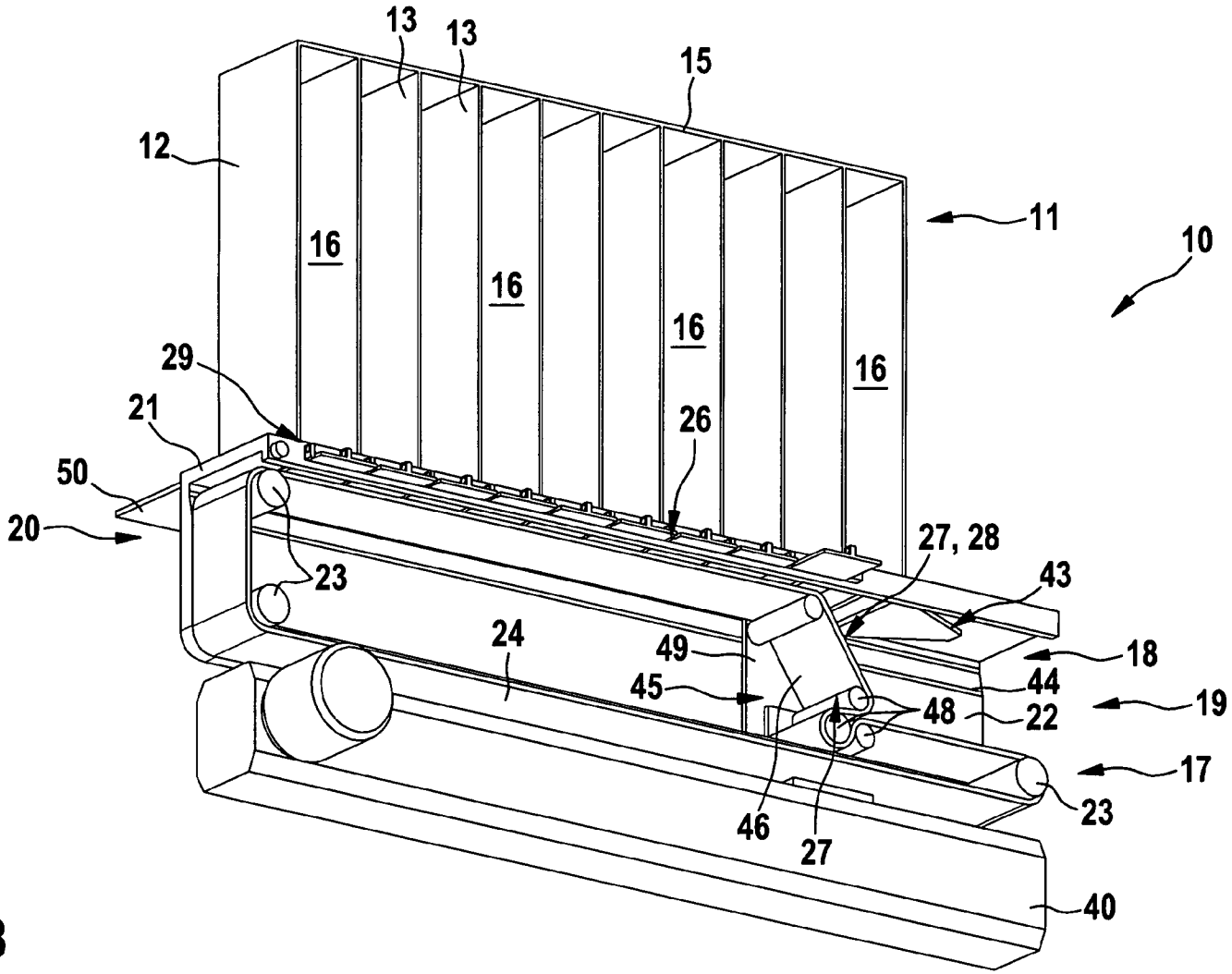

In the embodiment described in FIGS. 6 to 8 the slide 28 forms an integral part of the conveying element 17. The conveying element 17 is for this purpose repeatedly deflected in the region of a deflecting unit 45. Several deflecting rollers 48 are arranged in the region of a slidable plate 49, such that the conveying element 17 runs obliquely in the region of the deflecting unit 45 which forms the slide 28. This ramp-like path of the section 46 of the conveying element 17 in turn serves as a deflector for the products dropping out of the shafts 16. The deflecting unit 45 can be driven by the linear unit 40 or the like. Due to sliding of the deflecting unit 45 the individual function zones (receiving zone for the product stream, return zone, etc.) of the conveying element 17 are varied.

Figure 2:
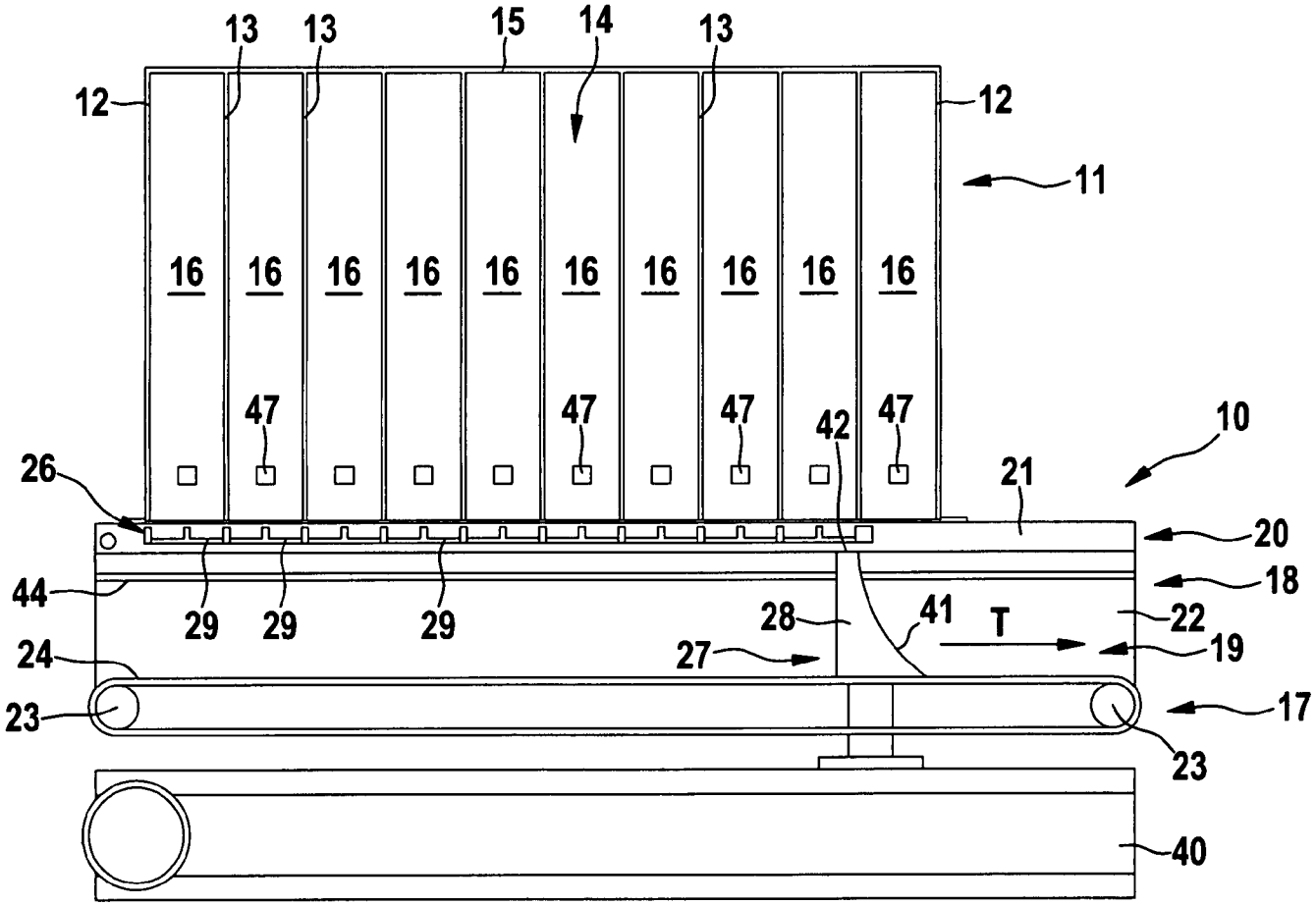
Figure 3:
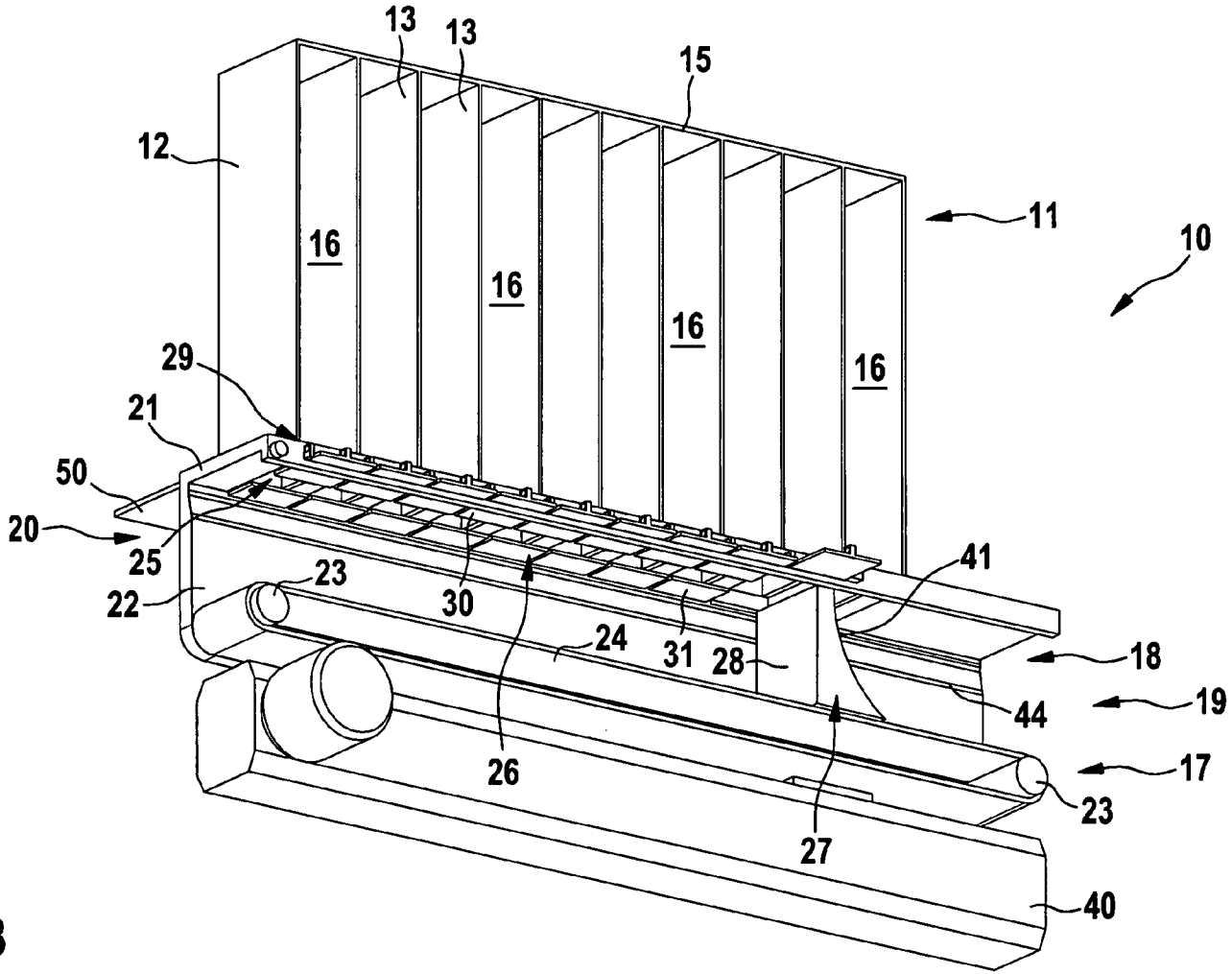

Optionally, the discharge hopper 10 may be assigned sensors. Preferably the discharge hopper 10 has several sensors 47 which are constructed and designed for detecting the level within the shafts 16 of a shaft tray 11 to be emptied. In the embodiments described, the number of sensors corresponds to the number of shafts 16 of a shaft tray 11 to be emptied. As can be seen e.g. in FIG. 2, the sensors 47 in relation to the position of the shaft tray 11 in FIG. 2 are arranged in such a way that the lower region of the shafts 16 is monitored. The sensors 47 can be attached to suitable frames or the like of the discharge hopper 10.

Other embodiments are possible too. Thus the technical constructions described for the individual embodiments can also be transferred to the other embodiments. In the embodiment according to FIGS. 6 to 8, for example, the conveying element 17 could basically also assume the function of the belt element 32, so that optionally the shaft barriers 29 can be dispensed with.

Below, the principle of the method which essentially applies to all the embodiments shown is described in more detail. The shaft tray 11 is first closed by means of a closure element, e.g. a slide bottom 50, and in the closed state upside down, that is, with the slide bottom 50 pointing down, is coupled to the conveying element 17 in the region of the connecting means 18. The slide 28 is at the beginning of a cycle in the right end position shown e.g. in FIG. 1. Further, the closure means 26 closes the opening 25, so that the channel 19 is closed. Preferably only the shaft 16 which is on the right in FIG. 1 remains open. After pulling back the slide bottom 50 into an open position (see FIG. 1), the products of the right shaft 16 drop directly into the channel 19. The contents of the other shafts 16 remain on top of the closure means 26, that is, the individual shaft barriers 29 or the belt element 32. Optionally, this can also apply to the right shaft 16.

The conveying element 17 is driven continuously and carries away the product stream flowing out of the first right shaft 16. The contents of the right shaft 16 now run off continuously, following the force of gravity, and are carried away through the channel 19 by the conveying element 17. Just before complete emptying of the shaft 16, the slide 28 is moved by the width of one shaft to the left in the direction opposite the direction of transport T of the product stream. The presettable minimum volume within the shaft 16 can e.g. be detected by the sensors 47. Due to the movement of the slide 28, the adjacent shaft 16 or the closure means 26 of the adjacent shaft 16 opens automatically. For a brief moment two shafts 16 are open simultaneously, so that for a short time two shafts 16 are emptied simultaneously into the channel 19 to produce a gap-free product stream. Depending on the driving speed of the conveying element 17, a strictly serial cycle is possible too. To put it another way, an overlap between two adjacent shafts 16 during sliding of the slide 28 can be dispensed with.

The preferably cyclic movement of the slide 28 from right to left (starting from the position of the slide 28 e.g. in FIG. 1) continues until the slide 28 passes into a left end position. After emptying of the left shaft 16, the slide 28 is moved back to the right into its right end position synchronously with the current conveying speed of the belt element 24 of the conveying element 17, so that the contents of the channel 19 are emptied as far as the right end position of the slide 28. The closure means 26, that is, the shaft barriers 29 or the belt element 32 close again behind the slide 28. The time between the movement of the slide 28 from the left end position immediately after emptying of the last shaft 16 furthest to the left, to the right end position, is available for a change of tray. The products which are in the channel 19 serve as a buffer, so that the product stream does not break away in spite of the change of tray. As soon as the change of tray is over, the products of the first shaft 16 of the subsequent shaft tray 11 seamlessly join on to the product stream which is in the channel 19. For the principle of the method it is unimportant what kind of closure means 26 is selected. Also the design of the slide 28 is not relevant for the process described. The method can be carried out in a corresponding manner with the most varied embodiments.

The invention claimed is:

1. A discharge hopper for a tray discharge station for serially discharging a shaft tray having shafts filled with rod-shaped products, comprising:

a conveying element for carrying away the products flowing from the shaft tray;

a connecting device to couple the shaft tray to be emptied to the conveying element, the connecting device being arranged substantially parallel to and spaced apart from the conveying element to form a channel for the product flow and comprising an opening for passage of the products from the shaft tray into the channel;

a movable actuating element, wherein the actuating element comprises a slide, and wherein the slide is movable within the channel in a direction of transport and in a direction opposite the direction of transport of the products carried away by the conveying element; and a closure unit functionally coupled to the movable actuating element and constructed to open and close the opening in the connecting device, whereby the shaft tray is emptied shaft by shaft.

2. The discharge hopper according to claim 1, wherein the closure unit includes a number of shaft barriers that corresponds to a maximum to the number of shafts of the shaft tray to be emptied.

3. The discharge hopper according to claim 2, wherein the shaft barriers are separately actuatable for each shaft.

4. The discharge hopper according to claim 2, wherein each shaft barrier comprises two slidable closure plates arranged on opposite sides of the channel.

5. The discharge hopper according to claim 4, wherein the closure plates of a shaft barrier are movable within the channel transversely to the direction of transport of the product flow carried away by the conveying element.

6. The discharge hopper according to claim 4, wherein the closure plates are spring-loaded.

7. The discharge hopper according to claim 1, further comprising a linear drive unit coupled to drive the slide.

8. The discharge hopper according to claim 1, wherein the slide has a side facing towards the product flow which is in the channel and said side includes a radius for forming a deflection surface for the products.

9. The discharge hopper according to claim 1, wherein the slide has a side facing towards the closure unit and extending into a region of the closure unit to open the closure unit.

10. The discharge hopper according to claim 1, wherein the closure unit comprises movable closure plates, the discharge hopper comprising a feed element associated with the slide to force apart the closure plates both during movement of the slide in the direction of transport of the flow of products in the channel and during movement in the direction opposite the direction of transport.

11. The discharge hopper according to claim 1, wherein the discharge hopper includes a plurality of sensors to detect a level of the products within the respective shafts of the shaft tray to be emptied.

12. The discharge hopper according to claim 11, wherein the number of sensors corresponds to the number of shafts of the shaft tray to be emptied.

13. A discharge hopper for a tray discharge station for serially discharging a shaft tray having shafts filled with rod-shaped products, comprising:

a conveying element for carrying away the products flowing from the shaft tray;

a connecting device to couple the shaft tray to be emptied to the conveying element, the connecting device being arranged substantially parallel to and spaced apart from the conveying element to form a channel for the product flow and comprising an opening for passage of the products from the shaft tray into the channel;

a movable actuating element; and a closure unit functionally coupled to the movable actuating element and constructed to open and close the opening in the connecting device, whereby the shaft tray is emptied shaft by shaft and wherein the closure unit comprises a belt element.

14. The discharge hopper according to claim 13, further including a plurality of deflecting elements, wherein the belt element has one end attached to the connecting device and another free end including a tensioning element, the belt element being guided over the plurality of deflecting elements.

15. The discharge hopper according to claim 14, wherein at least one deflecting element is movable parallel to the channel.

16. The discharge hopper according to claim 14, wherein the tensioning element comprises a weight attached to the free end of the belt element.

17. A method for serially discharging a shaft tray filled with rod-shaped products, wherein the shaft tray has a plurality of shafts and is insertable into a discharge hopper having a connecting element that connects with the shaft tray and a conveying element that defines with the connecting element a channel in which the products are carried away by the conveying element, the method comprising steps of:

delivering the shaft tray to be emptied upside down into a region of the channel formed by the conveying element and the connecting element;

opening all the shafts of the upside-down shaft tray simultaneously;

at least partially retaining on a closure unit the products flowing from the shafts of the shaft tray immediately above the channel;

driving the closure unit with an actuating element to discharge the products shaft by shaft to the channel; and carrying away the products which flow out of the shaft tray into the channel by the conveying element.

18. The method according to claim 17, wherein the driving step includes pushing open the closure unit shaft by shaft with the actuating element.

19. The method according to claim 18, wherein the actuating element comprises a slide, and the driving step includes moving the slide within the channel in a direction of transport of the flow of products being carried away by the conveying element and in a direction opposite the direction of transport of the product flow to open the closure unit.

20. The method according to claim 17, wherein the driving step includes automatically closing the shaft tray shaft by shaft with the closure unit after the opening step.

21. The method according to claim 17, including monitoring a level of the products in the shafts and using the data obtained from the monitoring to control the actuating element.

22. The method according to claim 17, wherein the driving step includes temporarily emptying two adjacent shafts into the channel.

* * * * *